US010751780B2

(12) United States Patent
Saika et al.

(10) Patent No.: US 10,751,780 B2
(45) Date of Patent: Aug. 25, 2020

(54) FORMING DEVICE

(71) Applicant: SUMITOMO HEAVY INDUSTRIES, LTD., Tokyo (JP)

(72) Inventors: Masayuki Saika, Ehime (JP); Masayuki Ishizuka, Ehime (JP); Norieda Ueno, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 308 days.

(21) Appl. No.: 15/717,758

(22) Filed: Sep. 27, 2017

(65) Prior Publication Data

US 2018/0015521 A1 Jan. 18, 2018

Related U.S. Application Data

(63) Continuation of application No. PCT/JP2016/059704, filed on Mar. 25, 2016.

(30) Foreign Application Priority Data

Mar. 31, 2015 (JP) ..... 2015-072467

(51) Int. Cl.
*B21D 26/047* (2011.01)
*B21D 26/041* (2011.01)
(Continued)

(52) U.S. Cl.
CPC ..... *B21D 26/047* (2013.01); *B21D 26/027* (2013.01); *B21D 26/033* (2013.01); *B21D 26/041* (2013.01)

(58) Field of Classification Search
CPC .. B21D 26/041; B21D 26/047; B21D 26/033; B21D 26/035; B21D 26/02; B21D 26/00;
(Continued)

(56) References Cited

U.S. PATENT DOCUMENTS 2,861,530 A * 11/1958 Macha ..... B21D 26/041 72/62
10,137,491 B2 * 11/2018 Ishizuka ..... B21D 26/047
(Continued)

FOREIGN PATENT DOCUMENTS

CN 103527860 A * 1/2014
DE 102007017194 A1 * 4/2008 ..... B21D 26/037
(Continued)

OTHER PUBLICATIONS

Machine Translation of JP-2012000654-A from Espacenet, Takashi, Patent Year 2012, 15 pages (Year: 2019).*
(Continued)

*Primary Examiner* — Teresa M Ekiert
*Assistant Examiner* — Sarkis A Aktavoukian
(74) *Attorney, Agent, or Firm* — Michael Best & Friedrich LLP

(57) ABSTRACT

A forming device that forms a metal pipe by blow forming includes: a gas supply part that supplies a gas to a metal pipe material to expand the metal pipe material; a die attachment part to which a die that is brought into contact with the expanded metal pipe material to form the metal pipe is attached; a gas discharge part that discharges the gas from the metal pipe material; and a pressure detector that detects a pressure of the gas, the gas supply part includes a gas compression part that compresses the gas, and a supply line that transfers the gas compressed by the gas compression part to the metal pipe material, the gas discharge part includes a discharge line that transfers the discharged gas, and the pressure detector is provided in each of the supply line and the discharge line.

4 Claims, 6 Drawing Sheets

(51) Int. Cl.
*B21D 26/033* (2011.01)
*B21D 26/027* (2011.01)

(58) Field of Classification Search
CPC .. B21D 26/027; B21D 26/029; B21D 26/023; B21D 26/031
See application file for complete search history.

(56) References Cited

U.S. PATENT DOCUMENTS

| | | | | |
|---|---|---|---|---|
| 10,173,254 | B2 * | 1/2019 | Ueno | B21D 26/035 |
| 2004/0040636 | A1 | 3/2004 | Watanabe et al. | |
| 2004/0200550 | A1 * | 10/2004 | Pfaffmann | B21D 26/033 148/526 |
| 2013/0167607 | A1 * | 7/2013 | Adams | B21D 51/2669 72/61 |
| 2017/0048931 | A1 * | 2/2017 | Ueno | B21D 26/039 |
| 2017/0066028 | A1 * | 3/2017 | Ishizuka | B21D 26/039 |
| 2018/0078988 | A1 * | 3/2018 | Ishizuka | B21D 26/033 |
| 2018/0161843 | A1 * | 6/2018 | Saika | B21D 26/039 |
| 2018/0361458 | A1 * | 12/2018 | Ishizuka | B21D 26/041 |

FOREIGN PATENT DOCUMENTS

| | | | | |
|---|---|---|---|---|
| GB | 825783 | A * | 12/1959 | B21D 26/041 |
| GB | 2 379 180 | A | 3/2003 | |
| JP | S50-015775 | A | 2/1975 | |
| JP | S51-129860 | A | 11/1976 | |
| JP | S62-264870 | A | 11/1987 | |
| JP | 2003-154415 | A | 5/2003 | |
| JP | 2005-000943 | A | 1/2005 | |
| JP | 2009-220141 | A | 10/2009 | |
| JP | 2012-000654 | A | 1/2012 | |
| JP | 2012-040604 | A | 3/2012 | |

OTHER PUBLICATIONS

Machine Translation of DE-102007017194-A1 from Espacenet, Jens, Patent Year 2008, 6 pages (Year: 2019).*
Machine Translation of CN-103527860-A from Espacenet, Xuanyou, Patent Year 2014, 6 pages (Year: 2019).*
International Search report issued in Application No. PCT/JP2016/059704, dated Jun. 21, 2016.

* cited by examiner

FORMING DEVICE

RELATED APPLICATIONS

Priority is claimed to Japanese Patent Application No. 2015-072467, filed Mar. 31, 2015, and International Patent Application No. PCT/JP2016/059704, the entire content of each of which is incorporated herein by reference.

BACKGROUND

Technical Field

Certain embodiments of the present invention relate to a forming device.

Description of Related Art

A forming device has been known that forms a metal pipe using a die by closing the die and performing blow forming. For example, a forming device disclosed in the related art is provided with a die and a gas supply part that supplies a gas into a metal pipe material. In this forming device, the metal pipe material is disposed in the die, and in a state in which the die is closed, a gas is supplied into the metal pipe material from the gas supply part to expand the metal pipe material. Thus, the metal pipe material is formed into a shape corresponding to the shape of the die.

SUMMARY

According to an aspect of the invention, there is provided a forming device that forms a metal pipe by blow forming, the device including: a gas supply part configured to supply a gas to a metal pipe material to expand the metal pipe material; a die attachment part to which a die that is brought into contact with the expanded metal pipe material to form the metal pipe is attached; a gas discharge part configured to discharge the gas from the metal pipe material; and a pressure detector configured to detect a pressure of the gas, in which the gas supply part includes a gas compression part configured to compress the gas, and a supply line configured to transfer the gas compressed by the gas compression part to the metal pipe material, the gas discharge part includes a discharge line configured to transfer the discharged gas, and the pressure detector is provided in each of the supply line and the discharge line.

BRIEF DESCRIPTION OF THE DRAWINGS

FIG. 4A is a diagram showing a state in which a metal pipe material is set in the die. FIG. 4B is a diagram showing a state in which the metal pipe material is held by electrodes.

FIG. 6A is a view showing a state in which a metal pipe material is held by the electrodes. FIG. 6B is a view showing a state in which the blowing mechanism is brought into contact with the electrodes. FIG. 6C is a front view of the electrodes.

DETAILED DESCRIPTION

Figure 1:
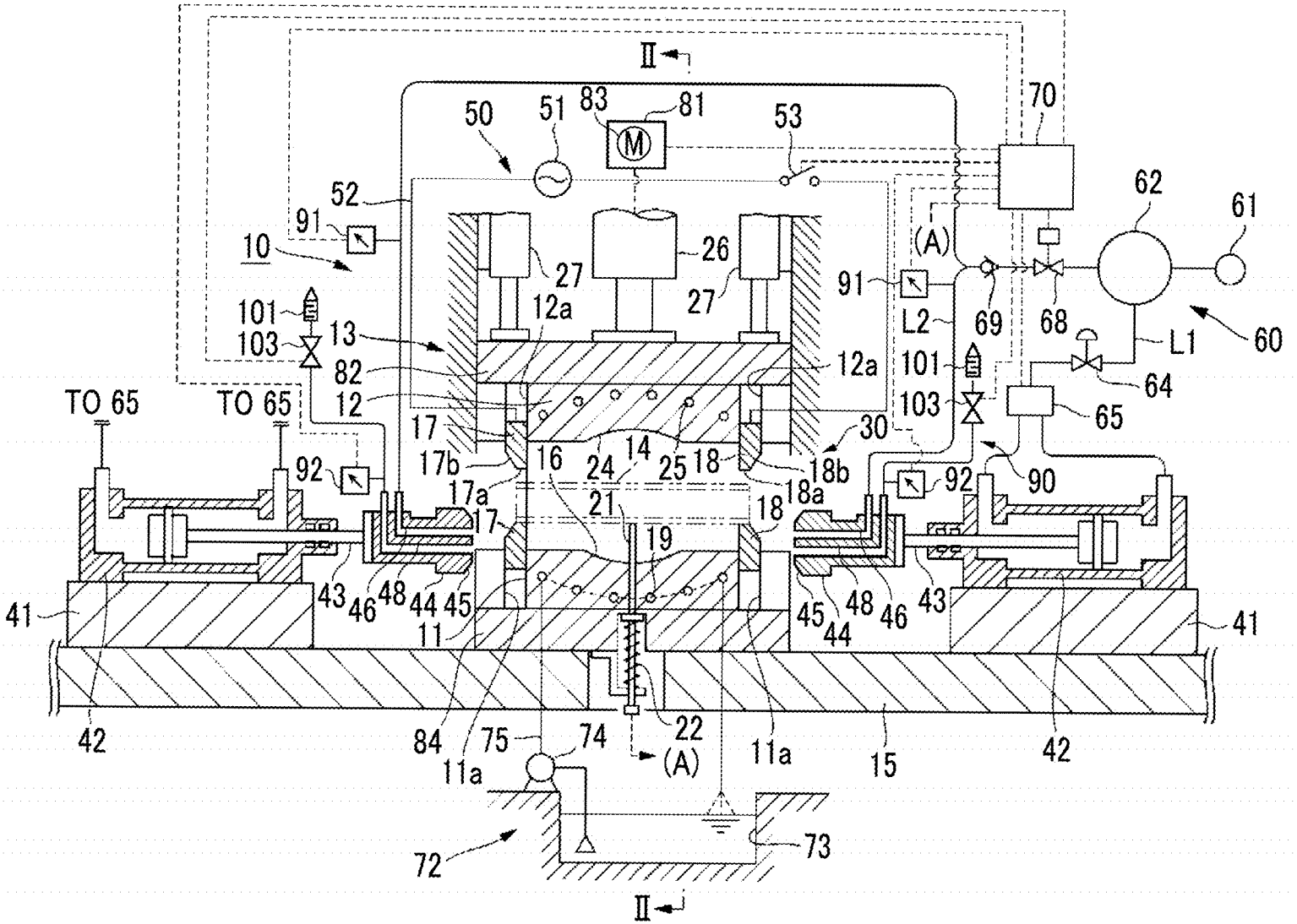
FIG. 1 is a schematic diagram of a configuration of a forming device according to an embodiment of the invention.

In the forming device, the pressure of the gas in the metal pipe material is required to be accurately adjusted in order to suitably expand the metal pipe material. However, in forming devices in the related art, the pressure of the gas in the metal pipe material is adjusted only by controlling the pressure of the supply source of the gas. Accordingly, in a case where an error occurs in the forming device, the pressure of the gas in the metal pipe material may not be accurately adjusted. In this case, there is a concern that the pressure of the gas in the metal pipe material may excessively increase.

It is desirable to provide a forming device that can suppress an excessive increase in the pressure of a gas in a metal pipe material.

In the forming device according to the aspect of the invention, the gas compressed by the gas compression part is transferred to the metal pipe material by the supply line, and the metal pipe material is expanded by the pressure of the gas. The expanded metal pipe material is formed into a metal pipe by being brought into contact with the die attached to the die attachment part. Then, the gas in the metal pipe material is transferred to the discharge line and discharged. Here, the gas pressures in the supply line and in the discharge line are detected by the pressure detectors respectively provided in the supply line and the discharge line. Accordingly, the gas pressures on the upstream side and the downstream side of the metal pipe material are detected. Accordingly, even in a case where an abnormal change occurs in the gas pressure in the metal pipe material, it is possible to detect and deal with the change in the pressure. Therefore, it is possible to suppress an excessive increase in the gas pressure in the metal pipe material.

The forming device according to the aspect of the invention may further include: a controller configured to control discharge of the gas by the gas discharge part, and in a case where the pressure of the gas in the supply line or the discharge line detected by the pressure detector is equal to or higher than a threshold, the controller may adjust an amount of the gas to be discharged by the gas discharge part. Accordingly, in a case where the gas pressure in the metal pipe material is excessively increased, the controller can adjust the amount of the gas to be discharged from the metal pipe material by the gas discharge part. Therefore, it is possible to suppress an excessive increase in the gas pressure in the metal pipe material.

In the forming device according to the aspect of the invention, the supply line may include a first supply line and a second supply line configured to transfer the gas to the metal pipe material, the discharge line may include a first discharge line and a second discharge line configured to transfer the gas discharged from the metal pipe material, and the pressure detector may be provided in each of the first discharge line and the second discharge line. In this case, the metal pipe material is rapidly expanded by transferring the gas to the metal pipe material via the pair of supply lines, and a metal pipe can be formed in a short period of time. In addition, the reliability of the pressure to be detected is improved by providing the pressure detector in each of the pair of discharge lines, and it is possible to suppress an excessive increase in the gas pressure in the metal pipe material.

In the forming device according to the aspect of the invention, the pressure detector may be provided in each of the first supply line and the second supply line. In this case, since the pressure detector can be provided just before the part that blows the gas into the metal pipe material, the reliability of the pressure to be detected is improved, and it is possible to suppress an excessive increase in the gas pressure in the metal pipe material.

Configuration of Forming Device

As shown in FIG. 1, a forming device 10 that forms a metal pipe is provided with a blow forming die (die) 13 composed of an upper die 12 and a lower die 11, a slide (die attachment part) 82 that moves at least one of the upper die 12 and the lower die 11, a driving part 81 that generates a driving force for moving the slide 82, a pipe holding mechanism 30 that holds a metal pipe material 14 between the upper die 12 and the lower die 11 in a horizontal direction, a heating mechanism 50 that energizes the metal pipe material 14 held by the pipe holding mechanism 30 to heat the metal pipe material, a water circulation mechanism 72 that forcibly cools the blow forming die 13 with water, a blowing mechanism (gas supply part) 60 that blows a high-pressure gas into the heated metal pipe material 14, an exhaust mechanism (gas discharge part) 90 that discharges the high-pressure gas from the metal pipe material 14, a supply-side pressure sensor (pressure detector) 91 that detects a pressure of the high-pressure gas in the blowing mechanism 60, a discharge-side pressure sensor (pressure detector) 92 that detects a pressure of the high-pressure gas in the exhaust mechanism 90, and a controller 70 that controls the driving part 81, the pipe holding mechanism 30, operations of the blow forming die 13, discharge of the high-pressure gas by the exhaust mechanism 90, the heating mechanism 50, and the blowing mechanism 60. In the following description, a pipe after the forming will be called a metal pipe 80 (see FIG. 2B), and a pipe in mid-course before the completion is reached will be called a metal pipe material 14.

Figure 6A:
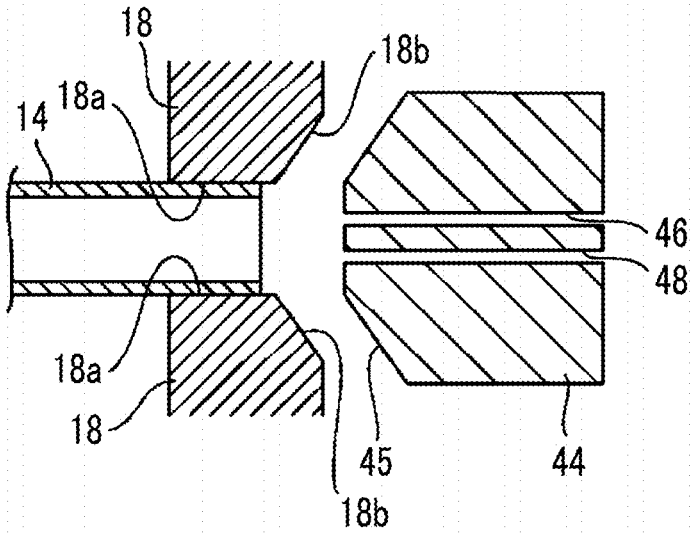
FIGS. 6A to 6C are enlarged views of the vicinity of the electrodes.
Figure 6B:
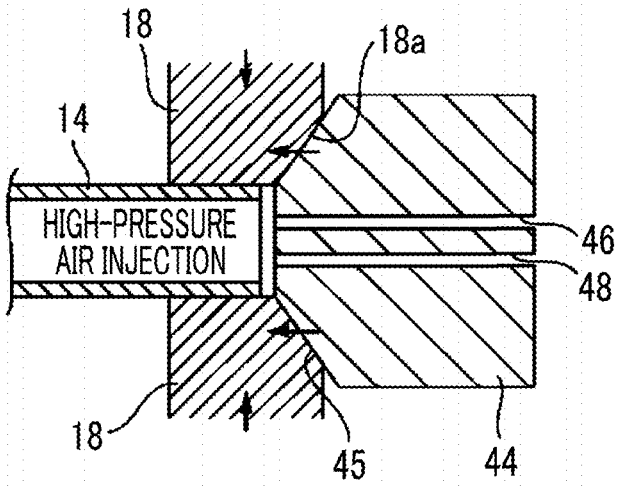
Figure 6C:
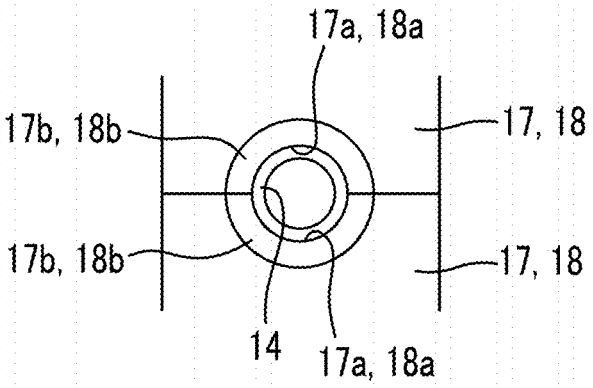

The lower die 11 is fixed to a large base 15 via a die mount 84 (die attachment part) 84. The blow forming die 13 can be replaced in accordance with a shape of a formed product. In a case where the blow forming die 13 is replaced, the lower die 11 is detached from the die mount 84 and a new lower die 11 is attached to the die mount 84. Otherwise, the lower die 11 may be detached together with the base 15 so as to be replaced by another base 15 provided with a new lower die 11. The lower die 11 is composed of a large steel block and is provided with a cavity (recessed part) 16 in an upper surface thereof. An electrode storage space 11*a* is provided near each of right and left ends (right and left ends in FIG. 1) of the lower die 11, and a first electrode 17 and a second electrode 18 that are configured to advance or retreat in a vertical direction by an actuator (not shown) are provided in the electrode storage spaces 11*a*. Recessed grooves 17*a* and 18*a* having a semi-arc shape corresponding to an outer peripheral surface on the lower side of the metal pipe material 14 are formed in upper surfaces of the first electrode 17 and the second electrode 18, respectively (see FIG. 6C), and the metal pipe material 14 can be placed to be well fitted in the recessed grooves 17*a* and 18*a*. In addition, in front surfaces of the first and second electrodes 17 and 18, tapered recessed surfaces 17*b* and 18*b* are formed such that the vicinities thereof are recessed at an angle into a tapered shape toward the recessed grooves 17*a* and 18*a*, respectively. The lower die 11 has a cooling water passage 19 formed therein and is provided with a thermocouple 21 inserted from the bottom at a substantially center thereof. This thermocouple 21 is supported movably up and down by a spring 22.

The pair of first and second electrodes 17 and 18 positioned in the lower die 11 also serve as the pipe holding mechanism 30 and can elevatably support the metal pipe material 14 in the horizontal direction between the upper die 12 and the lower die 11. The thermocouple 21 is just an example of the temperature measuring unit, and a non-contact temperature sensor such as a radiation thermometer or an optical thermometer may be provided. A configuration without the temperature measuring unit may also be employed if the correlation between the energization time and the temperature can be obtained.

The upper die 12 is a large steel block that is provided with a cavity (recessed part) 24 in a lower surface thereof and a cooling water passage 25 built therein. An upper end part of the upper die 12 is fixed to the slide 82. In a case where the blow forming die 13 is replaced, the upper die 12 is detached from the slide 82 and a new upper die 12 is attached to the slide 82. The slide 82 to which the upper die 12 is fixed is suspended by a pressing cylinder 26, and is guided by a guide cylinder 27 so as not to laterally vibrate. The driving part 81 according to this embodiment is provided with a servo motor 83 that generates a driving force for moving the slide 82. The driving part 81 is composed of a fluid supply part that supplies a fluid (an operating oil in a case where a hydraulic cylinder is employed as the pressing cylinder 26) for driving the pressing cylinder 26 to the pressing cylinder 26. The controller 70 can control the movement of the slide 82 by controlling the amount of the fluid to be supplied to the pressing cylinder 26 by controlling the servo motor 83 of the driving part 81. The driving part 81 is not limited to a part that applies a driving force to the slide 82 via the pressing cylinder 26 as described above. For example, the driving part may be mechanically connected to the slide 82 to directly or indirectly apply a driving force generated by the servo motor 83 to the slide 82. For example, a mechanism that has an eccentric shaft, to which the slide 82 is attached, and a servo motor that rotates the eccentric shaft can be employed. In this embodiment, only the upper die 12 is moved, but the lower die 11 may be moved in addition to or in place of the upper die 12. In this embodiment, the driving part 81 may not have the servo motor 83.

Similarly to the case of the lower die 11, in electrode storage spaces 12*a* respectively provided near right and left ends (right and left ends in FIG. 1) of the upper die 12, a first electrode 17 and a second electrode 18 that are configured to advance or retreat in the vertical direction by an actuator (not shown) are provided. Recessed grooves 17*a* and 18*a* having a semi-arc shape corresponding to an outer peripheral surface on the upper side of the metal pipe material 14 are formed in lower surfaces of the first and second electrodes 17 and 18, respectively (see FIG. 6C), and the metal pipe material 14 can be well fitted in the recessed grooves 17*a* and 18*a*. In addition, in front surfaces of the first and second electrodes 17 and 18 (surfaces of the die in an outward direction), tapered recessed surfaces 17*b* and 18*b* are formed such that the vicinities thereof are recessed at an angle into a tapered shape toward the recessed grooves 17*a* and 18*a*, respectively. That is, in a case where the metal pipe material 14 is sandwiched between the upper and lower pairs of first and second electrodes 17 and 18 from the vertical direction, the metal pipe material 14 can be surrounded such that the outer periphery thereof firmly adheres well over the whole periphery.

Figure 2A:
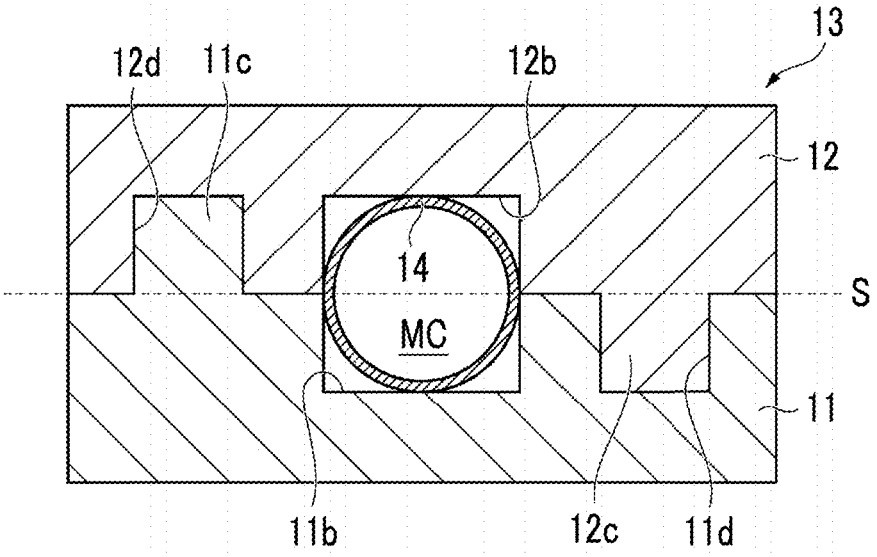
FIGS. 2A and 2B are schematic cross-sectional views of a blow forming die, taken along the line II-II shown in FIG. 1.
Figure 2B:
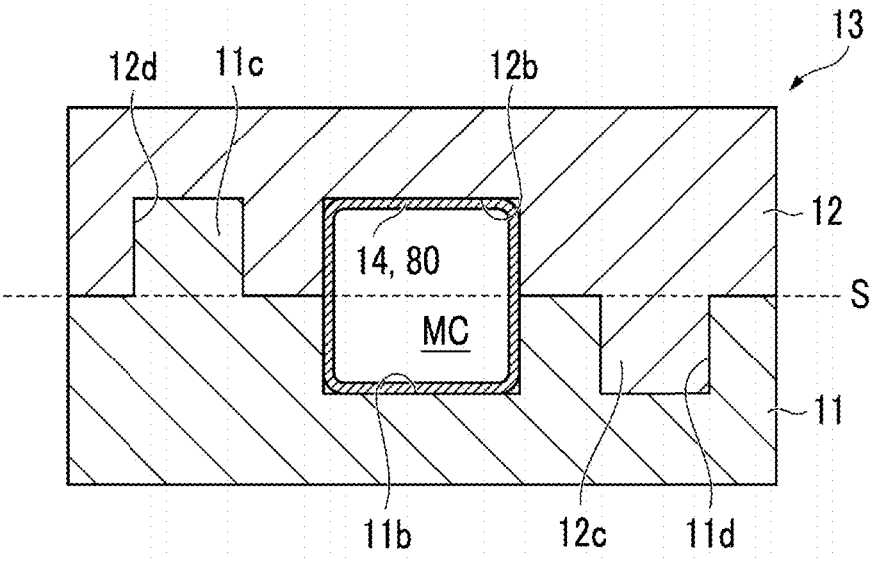

FIGS. 2A and 2B schematically show a cross-section of the blow forming die 13. These are cross-sectional views of the blow forming die 13, taken along the line II-II of FIG. 1, and show a state of the die position during the blow forming. As shown in FIGS. 2A and 2B, in a case where a reference line S corresponds to the positions of the upper surface of the lower die 11 and the lower surface of the upper die 12 when the die is closed, the upper surface of the lower die 11 has a rectangular recessed part 11*b* recessed in a (downward) direction separating from the reference line S, and the lower surface of the upper die 12 has a rectangular recessed part 12*b* recessed in a (upward) direction separating from the reference line S at a position opposed to the recessed part 11*b* of the lower die 11. In addition, in the upper surface of the lower die 11, a rectangular protrusion 11*c* is formed on one side (left side in FIG. 2) in the horizontal direction of the recessed part 11*b*, and a rectangular recessed part 11*d* is formed on the other side (right side in FIG. 2) in the horizontal direction of the recessed part 11*b*. In the lower surface of the upper die 12, a rectangular recessed part 12*d* is formed at a position corresponding to the protrusion 11*c* of the lower die 11, and a rectangular protrusion 12*c* is formed at a position corresponding to the recessed part 11*d*. In a state in which the blow forming die 13 is closed, a main cavity part MC that is a rectangular space is formed by combining the recessed part 11*b* of the lower die 11 and the recessed part 12*b* of the upper die 12. In this case, the protrusion 11*c* of the lower die 11 and the recessed part 12*d* of the upper die 12 are fitted together, and the recessed part 11*d* of the lower die 11 and the protrusion 12*c* of the upper die 12 are fitted together. The metal pipe material 14 disposed in the main cavity part MC as shown in FIG. 2A is brought into contact with an inner wall of the main cavity part MC as shown in FIG. 2B by being expanded, and is formed into the shape of the main cavity part MC (here, rectangular cross-sectional shape). The cross-sectional shape of the blow forming die 13 shown in FIGS. 2A and 2B is just an example and may be appropriately changed.

The heating mechanism 50 has a power supply 51, conductive wires 52 that extend from the power supply 51 and are connected to the first electrodes 17 and the second electrodes 18, and a switch 53 that is provided in the conductive wire 52.

The water circulation mechanism 72 includes a water tank 73 that stores water, a water pump 74 that draws up and pressurizes the water stored in the water tank 73 to send the water to the cooling water passage 19 of the lower die 11 and the cooling water passage 25 of the upper die 12, and a pipe 75. Although omitted, a cooling tower that lowers the water temperature or a filter that purifies the water may be provided in the pipe 75.

Figure 3:
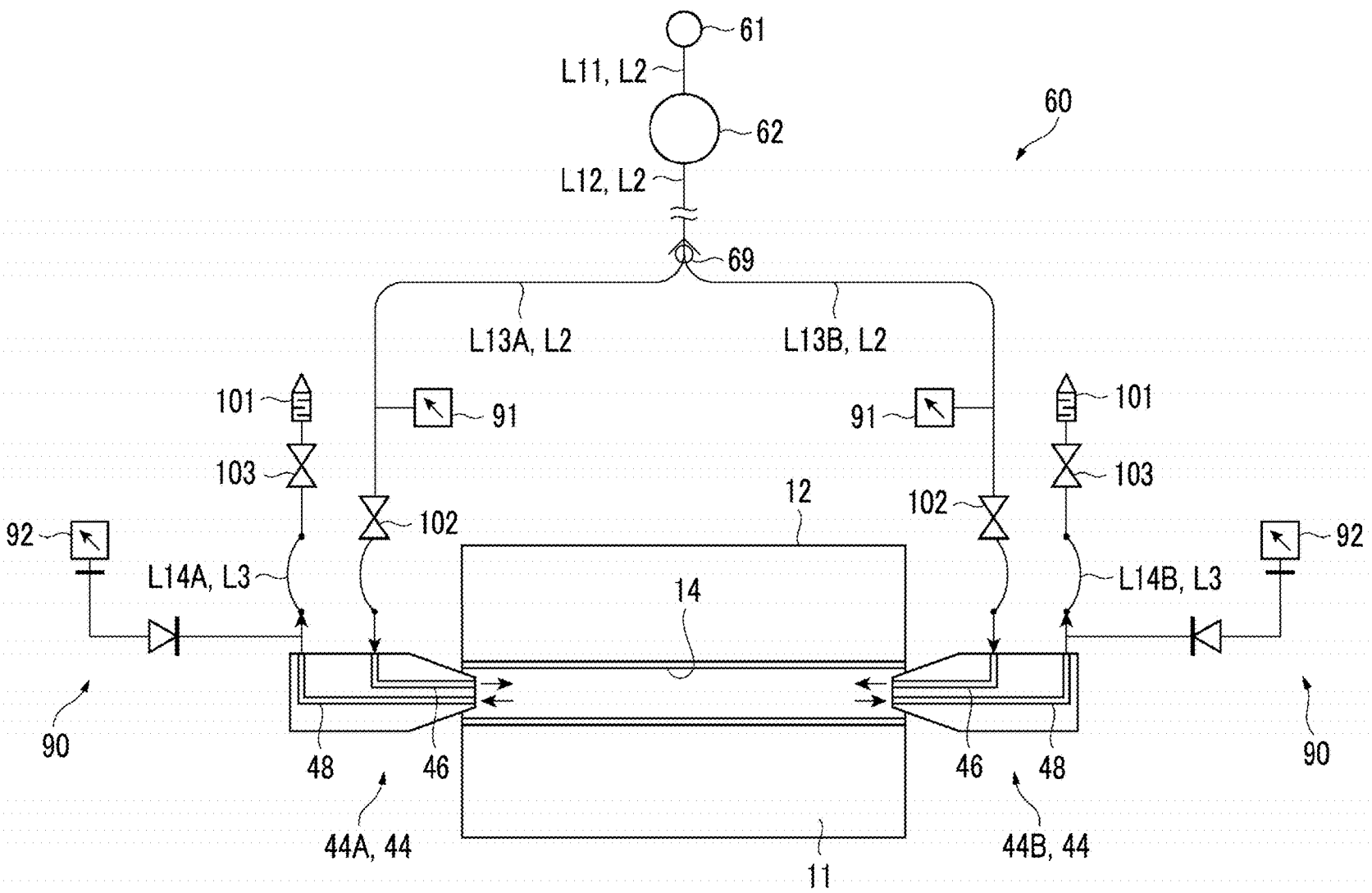
FIG. 3 is a schematic diagram of a configuration of a blowing mechanism shown in FIG. 1.

As shown in FIGS. 1 and 3, the blowing mechanism 60 is provided with a gas compression part 61 such as a compressor that compresses a gas to obtain a high-pressure gas, an accumulator 62 that stores the high-pressure gas compressed by the gas compression part 61, a supply line L1 for cylinder driving that transfers the high-pressure gas compressed by the gas compression part 61 to a cylinder unit 42, a pressure control valve 64 and a switching valve 65 that are provided in the supply line L1 for cylinder driving, a supply line (supply line) L2 for forming that transfers the high-pressure gas compressed by the gas compression part 61 to the metal pipe material 14, and on-off valves 68 and 102 and a check valve 69 that are provided in the supply line L2 for forming. In the example shown in FIG. 1, the supply line L1 for cylinder driving and the supply line L2 for forming are configured as a common line between the gas compression part 61 and the accumulator 62, and are branched in the accumulator 62. A tapered surface 45 is formed at a tip end of a sealing member 44 so as to be tapered. The tapered surfaces are formed into such a shape as to be well fitted in and brought into contact with the tapered recessed surfaces 17*b* and 18*b* of the first and second electrodes 17 and 18 (see FIGS. 6A to 6C). The sealing member 44 is connected to the cylinder unit 42 via a cylinder rod 43 to be able to advance or retreat in accordance with the operation of the cylinder unit 42. The cylinder unit 42 is placed and fixed on the base 15 via a block 41.

The pressure control valve 64 functions to supply, to the cylinder unit 42, a high-pressure gas having an operation pressure adapted for the pressing force requested from the sealing member 44. The check valve 69 functions to prevent the high-pressure gas from flowing backward in the supply line L2 for forming. The controller 70 acquires temperature information from the thermocouple 21 by the transmission of the information from a part (A) connected to the thermocouple 21 to a part (A) connected to the controller 70 in FIG. 1, and controls the pressing cylinder 26, the switch 53, the switching valve 65, the on-off valve 68, and the like.

The supply line L2 for forming is provided with a line L11 connecting the gas compression part 61 and the accumulator 62, a line L12 extending toward the sealing member 44 from the accumulator 62, a first supply line L13A branched from the line L12 and directed toward one end of the metal pipe material, and a second supply line L13B branched from the line L12 and directed toward the other end of the metal pipe material.

One sealing member 44A is formed at a tip end on the downstream side of the first supply line L13A. The sealing member 44A seals an end part of the metal pipe material 14 and blows the high-pressure gas transferred by the first supply line L13A into the metal pipe material 14. A flow passage for the high-pressure gas that is supplied into the metal pipe material 14 is formed in the sealing member 44A so as to penetrate the sealing member. The first supply line L13A is provided with an on-off valve 102.

The other sealing member 44B is formed at a tip end on the downstream side of the second supply line L13B. The sealing member 44B seals an end part of the metal pipe material 14 and blows the high-pressure gas transferred by the second supply line L13B into the metal pipe material 14. A flow passage for the high-pressure gas that is supplied into the metal pipe material 14 is formed in the sealing member 44B so as to penetrate the sealing member. The second supply line L13B is provided with an on-off valve 102.

The exhaust mechanism 90 is provided with a discharge line L3 that transfers the high-pressure gas discharged from the metal pipe material 14, a discharge adjustment valve 103 that is provided in the discharge line L3, and a muffler 101 that is provided at a tip end part on the downstream side of the discharge line L3. The discharge line L3 has a first discharge line L14A that extends from one end side of the metal pipe material 14 and a second discharge line L14B that extends from the other end side of the metal pipe material 14. The muffler 101 is provided at a tip end part on the downstream side of each of the first discharge line L14A and the second discharge line L14B.

One sealing member 44A is formed at a tip end on the upstream side of the first discharge line L14A. The sealing member 44A seals an end part of the metal pipe material 14 and sends the high-pressure gas discharged from the metal pipe material 14 to the first supply line L13A. A flow passage for the high-pressure gas that is discharged from the metal pipe material 14 is formed in the sealing member 44A so as to penetrate the sealing member.

The other sealing member 44B is formed at a tip end on the upstream side of the second discharge line L14B. The sealing member 44B seals an end part of the metal pipe material 14 and sends the high-pressure gas discharged from the metal pipe material 14 to the second supply line L13B. A flow passage for the high-pressure gas that is discharged from the metal pipe material 14 is formed in the sealing member 44B so as to penetrate the sealing member.

The discharge adjustment valve 103 is a valve for adjusting an amount of the high-pressure gas to be discharged from the metal pipe material 14 via the discharge line L3. Herein, for example, the discharge adjustment valve 103 adjusts an amount of the high-pressure gas to be discharged by changing the valve opening degree. The discharge adjustment valve 103 is provided in each of the first discharge line L14A and the second discharge line L14B.

The supply-side pressure sensor 91 is provided in the supply line L2 for forming to detect the pressure of the high-pressure gas in the supply line L2 for forming. In this embodiment, the supply-side pressure sensor 91 is provided in each of the first supply line L13A and the second supply line L13B to detect the pressure of the high-pressure gas in each of the first supply line L13A and the second supply line L13B. The supply-side pressure sensor 91 outputs the detected pressure value to the controller 70.

The discharge-side pressure sensor 92 is provided in the discharge line L3 to detect the pressure of the high-pressure gas in the discharge line L3. In this embodiment, the discharge-side pressure sensor 92 is provided in each of the first discharge line L14A and the second discharge line L14B to detect the pressure of the high-pressure gas in each of the first discharge line L14A and the second discharge line L14B. The discharge-side pressure sensor 92 outputs the detected pressure value to the controller 70.

In a case where the pressure values of the high-pressure gas detected by the supply-side pressure sensor 91 and the discharge-side pressure sensor 92 are input to the controller 70, the controller compares the detected values with a threshold set in advance. As a result, in a case where the detected value is equal to or higher than the threshold, the controller 70 adjusts the amount of the high-pressure gas to be discharged by the exhaust mechanism 90. Specifically, the controller 70 increases the amount of the high-pressure gas to be discharged by increasing the valve opening degree of the discharge adjustment valve 103 provided in the exhaust mechanism 90. As a result, the pressure of the gas in the metal pipe material 14 is reduced. In this case, the controller 70 may adjust the valve opening degree to 100% to more rapidly discharge the high-pressure gas.

Actions of Forming Device

Figure 4A:
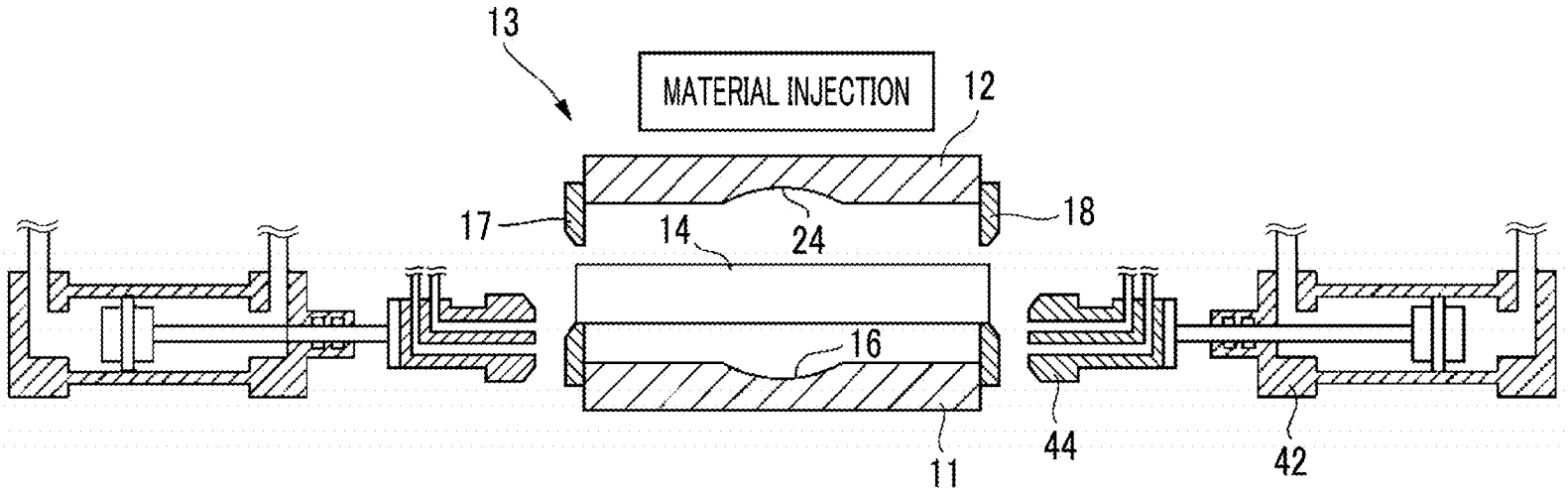
FIGS. 4A and 4B are diagrams showing a manufacturing step using the forming device.
Figure 4B:
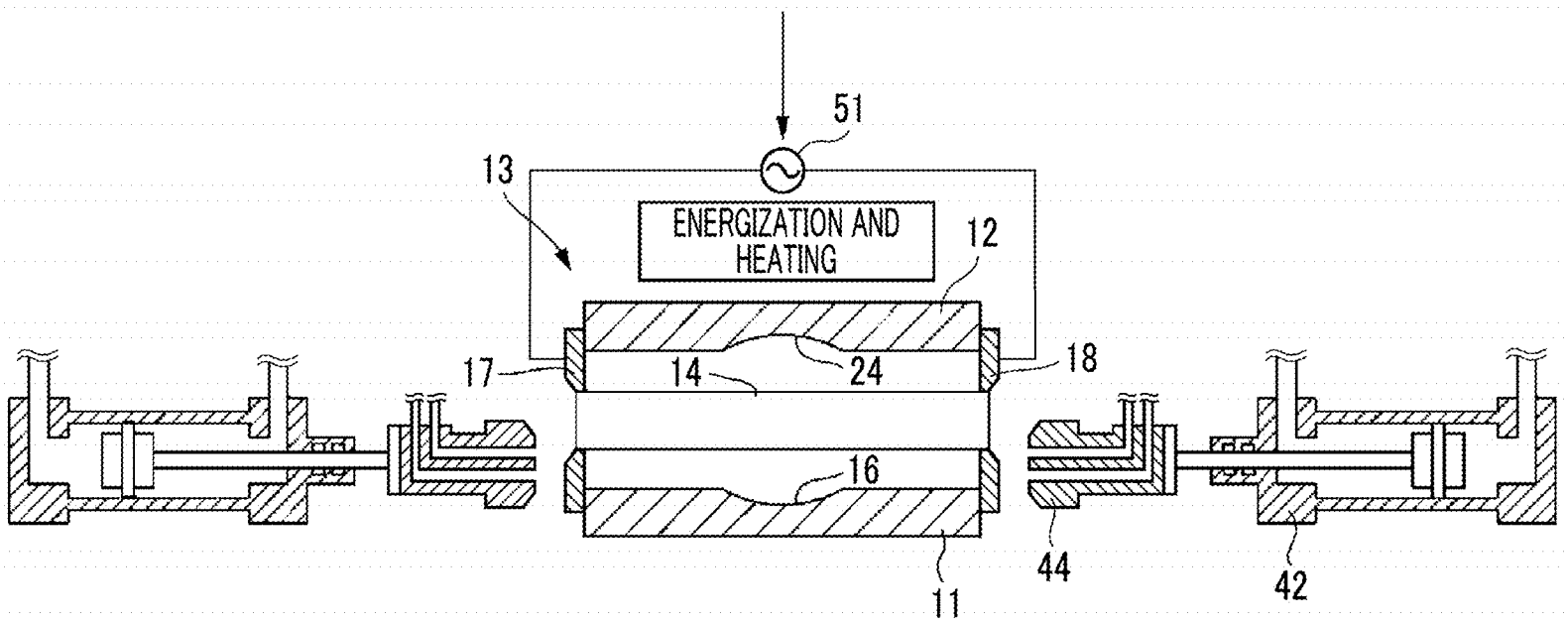

Next, the actions of the forming device 10 will be described. FIGS. 4A and 4B show steps from a pipe injection step for injecting the metal pipe material 14 as a material to an energization and heating step for heating the metal pipe material 14 by energization. As shown in FIG. 4A, a metal pipe material 14 that is a quenchable steel type is prepared and placed on the first and second electrodes 17 and 18 provided in the lower die 11 using, for example, a robot arm (not shown) or the like. Since the first and second electrodes 17 and 18 have the recessed grooves 17*a* and 18*a*, respectively, the metal pipe material 14 is positioned by the recessed grooves 17*a* and 18*a*. Next, the controller 70 (see FIG. 1) controls the pipe holding mechanism 30 to hold the metal pipe material 14 by the pipe holding mechanism 30. Specifically, as in FIG. 4B, an actuator that allows the electrodes 17 and 18 to advance or retreat is operated such that the first and second electrodes 17 and 18 positioned on the upper and lower sides, respectively, are brought closer to and into contact with each other. Due to this contact, both of the end parts of the metal pipe material 14 are sandwiched between the first and second electrodes 17 and 18 from the upper and lower sides. In addition, due to the presence of the recessed grooves 17*a* and 18*a* formed in the first and second electrodes 17 and 18, the metal pipe material 14 is sandwiched so as to firmly adhere over the whole periphery thereof. However, the invention is not limited to the configuration in which the metal pipe material 14 firmly adheres over the whole periphery thereof, and may have a configuration in which the first and second electrodes 17 and 18 are brought into contact with a part of the metal pipe material 14 in a peripheral direction.

Next, the controller 70 controls the heating mechanism 50 to heat the metal pipe material 14. Specifically, the controller 70 turns on the switch 53 of the heating mechanism 50. In that case, electric power is supplied from the power supply 51 to the metal pipe material 14, and the metal pipe material 14 produces heat (Joule heat) due to the resistance present in the metal pipe material 14. In this case, the measurement value of the thermocouple 21 is monitored always, and based on the results thereof, the energization is controlled.

Figure 5:
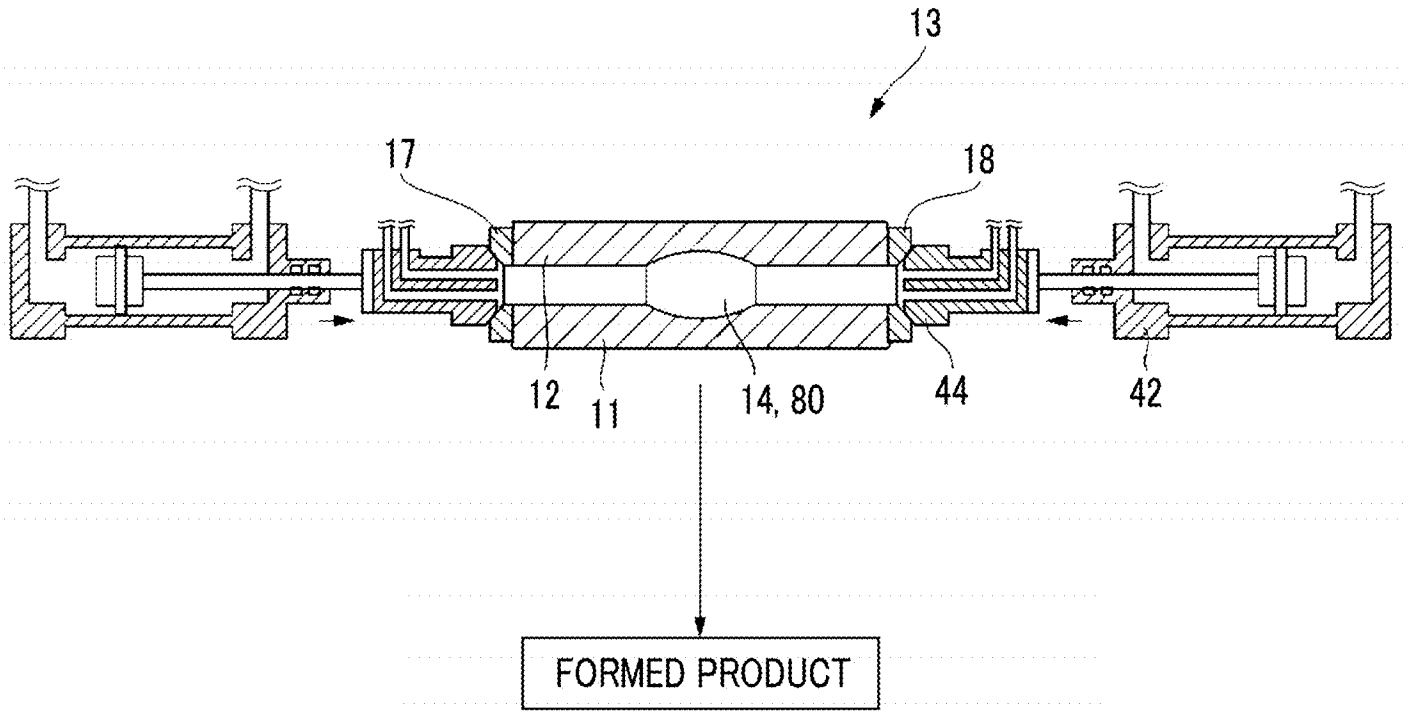
FIG. 5 is a diagram showing a blow forming step using the forming device.

FIG. 5 shows the blow forming and the processing contents after the blow forming. Specifically, as shown in FIG. 5, the blow forming die 13 is closed with respect to the metal pipe material 14 after the heating to dispose and seal the metal pipe material 14 in the cavity of the blow forming die 13. After that, the cylinder unit 42 is operated to seal both ends of the metal pipe material 14 by the sealing members 44A and 44B constituting a part of the blowing mechanism 60 (see FIGS. 6A to 6C). Regarding this sealing, the sealing members 44A and 44B are not directly brought into contact with both end surfaces of the metal pipe material 14 for sealing. The sealing is performed in an indirect manner through the tapered recessed surfaces 17*b* and 18*b* formed in the first and second electrodes 17 and 18. Therefore, the sealing can be performed in large areas, and thus the sealing performance can be improved, the sealing members are prevented from wearing by repeated sealing operations, and both end surfaces of the metal pipe material 14 is effectively prevented from crushing. After the completion of the sealing, the high-pressure gas is blown into the metal pipe material 14 from a gas passage 46 to deform the metal pipe material 14 softened by heating along the shape of the cavity.

The metal pipe material 14 is softened by being heated at a high temperature (about 950° C.) and can be subjected to the blow forming at a relatively low pressure. Specifically, in a case where compressed air at room temperature (25° C.) with 4 MPa is employed as the high-pressure gas, the compressed air is heated to about 950° C. in the sealed metal pipe material 14. The compressed air is thermally expanded and the pressure thereof reaches about 16 to 17 MPa based on the Boyle-Charle's law. That is, the metal pipe material 14 at 950° C. can be easily subjected to the blow forming.

The outer peripheral surface of the metal pipe material 14 expanded by being subjected to the blow forming is brought into contact with the cavity 16 of the lower die 11 so as to be rapidly cooled, and simultaneously, brought into contact with the cavity 24 of the upper die 12 so as to be rapidly cooled (since the upper die 12 and the lower die 11 have a large heat capacity and are managed at a low temperature, the heat of the pipe surface is taken to the dies at once in a case where the metal pipe material 14 is brought into contact with the dies). Such a cooling method is referred to as die contact cooling or die cooling. Then, a metal pipe 80 can be formed in a case where the die is opened.

Here, in a case where the high-pressure gas is supplied into the metal pipe material 14 by the blowing mechanism 60, the pressure of the high-pressure gas is detected in each of the first supply line L13A and the second supply line L13B by the supply-side pressure sensors 91 respectively provided in the first supply line L13A and the second supply line L13B. The detected pressure values are output to the controller 70.

In addition, in a case where the high-pressure gas is discharged from the metal pipe material 14 by the exhaust mechanism 90, the pressure of the high-pressure gas is detected in each of the first discharge line L14A and the second discharge line L14B by the discharge-side pressure sensors 92 respectively provided in the first discharge line L14A and the second discharge line L14B. The detected pressure values are output to the controller 70.

The controller 70 compares the pressure values of the high-pressure gas in the first supply line L13A and the second supply line L13B with a threshold set in advance. In a case where the pressure value is equal to or higher than the threshold, the controller 70 judges the pressure in the metal pipe material 14 to be excessively increased, and changes the valve opening degree of the discharge adjustment valve 103. Specifically, the controller 70 increases the valve opening degree of the discharge adjustment valve 103 provided in the exhaust mechanism 90. Accordingly, the amount of the high-pressure gas to be discharged from the discharge line L3 is increased, and as a result, the pressure of the gas in the metal pipe material 14 is reduced. In this case, the discharge adjustment valve 103 may not be suddenly completely opened, but the opening degree may be raised to some extent or gradually, and the discharge adjustment valve 103 may be completely opened when the pressure in the metal pipe material 14 is reduced to some extent. That is, the opening degree of the discharge adjustment valve 103 may be increased in a stepwise manner or continuously, and the discharge adjustment valve may be completely opened when the pressure in the metal pipe material 14 is reduced to a predetermined value or less. In a case where the discharge adjustment valve is suddenly completely opened, there is a concern that noise may be generated in association with the discharge of the high-pressure gas or breakdown may occur due to the burden on the crisis. However, it is possible to suppress the occurrence of noise or breakdown by such control.

In addition, the controller 70 compares the pressure values of the high-pressure gas in the first discharge line L14A and the second discharge line L14B with a threshold set in advance. In a case where the pressure value is equal to or higher than the threshold, the controller 70 judges the pressure in the metal pipe material 14 to be excessively increased, and changes the valve opening degree of the discharge adjustment valve 103. Specifically, the controller 70 increases the valve opening degree of the discharge adjustment valve 103 provided in the exhaust mechanism 90. Accordingly, the amount of the high-pressure gas to be discharged from the discharge line L3 is increased, and as a result, the pressure of the gas in the metal pipe material 14 is reduced. In this case, the discharge adjustment valve 103 may not be suddenly completely opened, but the opening degree may be raised to some extent or gradually, and the discharge adjustment valve 103 may be completely opened when the pressure in the metal pipe material 14 is reduced to some extent. That is, the opening degree of the discharge adjustment valve 103 may be increased in a stepwise manner or continuously, and the discharge adjustment valve may be completely opened when the pressure in the metal pipe material 14 is reduced to a predetermined value or less. In a case where the discharge adjustment valve is suddenly completely opened, there is a concern that noise may be generated in association with the discharge of the high-pressure gas or breakdown may occur due to the burden on the crisis. However, it is possible to suppress the occurrence of noise or breakdown by such control.

Next, the actions and effects of the forming device 10 according to this embodiment will be described.

In the forming device 10 according to this embodiment, the gas compressed by the gas compression part 61 is transferred to the metal pipe material 14 by the supply line L2 for forming, and the metal pipe material 14 is expanded by the pressure of the gas. The expanded metal pipe material 14 is formed into a metal pipe 80 by being brought into contact with the blow forming die 13 attached to the slide 82 and the die mount 84. Then, the gas in the metal pipe material 14 is transferred to the discharge line L3 and discharged. Here, the gas pressures in the supply line L2 for forming and in the discharge line L3 are detected by the supply-side pressure sensors 91 respectively provided in the first supply line L13A and the second supply line L13B and by the discharge-side pressure sensors 92 respectively provided in the first discharge line L14A and the second discharge line L14B. Accordingly, the gas pressures on the upstream side and the downstream side of the metal pipe material 14 are detected.

In a case where the forming device has no discharge-side pressure sensor 92 and is provided only with a supply-side pressure sensor 91 provided in the supply line L2 for forming, the supply-side pressure sensor 91 detects an abnormal change in the gas pressure occurring in the gas compression part 61 or the supply line L2 for forming. However, in such a configuration, it is difficult to detect an abnormal change in the gas pressure in the metal pipe material 14.

In addition, in a case where the forming device has no supply-side pressure sensor 91 and is provided only with a discharge-side pressure sensor 92 provided in the discharge line L3, the discharge-side pressure sensor 92 detects an abnormal change in the gas pressure occurring in any one of the gas compression part 61, the supply line L2 for forming, and the metal pipe material 14. However, in such a configuration, it is difficult to independently detect only an abnormal change in the gas pressure in the metal pipe material 14.

Differently from these configurations, the forming device 10 according to this embodiment is provided with both of the supply-side pressure sensor 91 and the discharge-side pressure sensor 92 as described above. Therefore, in the forming device 10, in a case where an abnormal change occurs in the gas pressure in the metal pipe material 14, only the change in the pressure can be independently detected. Accordingly, even in a case where an abnormal change occurs in the gas pressure in the metal pipe material 14, it is possible to detect and deal with the change in the pressure. Therefore, it is possible to suppress an excessive increase in the gas pressure in the metal pipe material 14.

In addition, the forming device 10 according to this embodiment is provided with the controller 70 that controls the discharge of the gas by the exhaust mechanism 90, and in a case where the gas pressure in the supply line L2 for forming detected by the supply-side pressure sensor 91, or the gas pressure in the discharge line L3 detected by the discharge-side pressure sensor 92 is equal to or higher than a threshold, the controller 70 increases the amount of the gas to be discharged by the discharge adjustment valve 103 of the exhaust mechanism 90. Accordingly, in a case where the gas pressure in the metal pipe material 14 is excessively increased, the controller 70 can reduce the gas pressure in the metal pipe material 14 by increasing the amount of the gas to be discharged from the metal pipe material 14 by the exhaust mechanism 90. Therefore, it is possible to suppress an excessive increase in the gas pressure in the metal pipe material 14.

In addition, in the forming device 10 according to this embodiment, the supply line L2 for forming has the first supply line L13A and the second supply line L13B that transfer the gas to the metal pipe material 14, the discharge line L3 has the first discharge line L14A and the second discharge line L14B that transfer the gas discharged from the metal pipe material 14, and the discharge-side pressure sensor 92 is provided in each of the first discharge line L14A and the second discharge line L14B. In this case, the metal pipe material 14 is rapidly expanded by transferring the gas to the metal pipe material 14 via the pair of supply lines L2 for forming, and a metal pipe 80 can be formed in a short period of time. In addition, the reliability of the pressure to be detected is improved by providing the discharge-side pressure sensor 92 in each of the pair of discharge lines L3, and it is possible to suppress an excessive increase in the gas pressure in the metal pipe material 14.

In addition, in the forming device 10 according to this embodiment, the supply-side pressure sensor 91 is provided in each of the first supply line L13A and the second supply line L13B. In this case, since the supply-side pressure sensor 91 can be provided just before the part that blows the gas into the metal pipe material 14, the reliability of the pressure to be detected is improved, and it is possible to suppress an excessive increase in the gas pressure in the metal pipe material 14.

The invention is not limited to the above-described embodiments.

In the above-described embodiments, in the supply line L2 for forming, the supply-side pressure sensor 91 is provided in each of the first supply line L13A and the second supply line L13B. However, the supply-side pressure sensor 91 may be provided in only one of the first supply line L13A and the second supply line L13B.

In the above-described embodiments, in the discharge line L3, the discharge-side pressure sensor 92 is provided in each of the first discharge line L14A and the second discharge line L14B. However, the discharge-side pressure sensor 92 may be provided in only one of the first discharge line L14A and the second discharge line L14B.

In the above-described embodiments, a configuration has been shown in which a gas is supplied from both ends of the metal pipe material 14. However, a configuration may be employed in which a gas is supplied from only one end of the metal pipe material 14. In this case, in the supply line L2 for forming, only one of the first supply line L13A and the second supply line L13B may be provided, and in the discharge line L3, only one of the first discharge line L14A and the second discharge line L14B may be provided.

The blow forming die 13 may be any one of a non-water-cooling die and a water-cooling die. However, a non-water-cooling die requires a long period of time in a case where the die is cooled to near room temperature after the completion of the blow forming. Regarding this, in a case of a water-cooling die, the cooling is completed in a short period of time. Accordingly, a water-cooling die is desirable from the viewpoint of an improvement in the productivity.

It should be understood that the invention is not limited to the above-described embodiment, but may be modified into various forms on the basis of the spirit of the invention. Additionally, the modifications are included in the scope of the invention.

What is claimed is:

1. A forming device that forms a metal pipe by blow forming, the device comprising:

a gas supply part configured to supply a gas to a metal pipe material to expand the metal pipe material;

a die attachment part to which a die that is brought into contact with the expanded metal pipe material to form the metal pipe is attached;

a gas discharge part configured to discharge the gas from the metal pipe material; and a supply-side pressure detector configured to detect a pressure of the gas, wherein the gas supply part includes:

a gas compression part configured to compress the gas, and a supply line configured to transfer the gas compressed by the gas compression part to the metal pipe material, the supply line includes a first supply line and a second supply line configured to transfer the gas to the metal pipe material, wherein the supply-side pressure detector is provided in the supply line, wherein the gas discharge part includes:

a discharge line configured to transfer the discharged gas from the metal pipe material, the discharge line includes a first discharge line and a second discharge line configured to transfer the gas discharged from the metal pipe material, and wherein a discharge-side pressure detector is provided in each of the first discharge line and the second discharge line.

2. The forming device according to claim 1, further comprising:

a controller configured to control discharge of the gas by the gas discharge part, wherein in a case where the pressure of the gas in the supply line detected by the supply-side pressure detector is equal to or higher than a threshold, the controller adjusts an amount of the gas to be discharged by the gas discharge part.

3. A forming device that forms a metal pipe by blow forming, the device comprising:

a gas supply part configured to supply a gas to a metal pipe material to expand the metal pipe material;

a die attachment part to which a die that is brought into contact with the expanded metal pipe material to form the metal pipe is attached;

a gas discharge part configured to discharge the gas from the metal pipe material; and a supply-side pressure detector configured to detect a pressure of the gas, wherein the gas supply part includes:

a gas compression part configured to compress the gas, and a supply line configured to transfer the gas compressed by the gas compression part to the metal pipe material, the supply line includes a first supply line and a second supply line configured to transfer the gas to the metal pipe material, wherein the supply-side pressure detector is provided in each of the first supply line and the second supply line, wherein the gas discharge part includes:

a discharge line configured to transfer the discharged gas from the metal pipe material, the discharge line includes a first discharge line and a second discharge line configured to transfer the gas discharged from the metal pipe material, wherein a discharge-side pressure detector is provided in each of the first discharge line and the second discharge line.

4. A forming device that forms a metal pipe by blow forming, the device comprising:

a gas supply part configured to supply a gas to a metal pipe material to expand the metal pipe material;

a die attachment part to which a die that is brought into contact with the expanded metal pipe material to form the metal pipe is attached;

a gas discharge part configured to discharge the gas from the metal pipe material; and a supply-side pressure detector configured to detect a pressure of the gas, wherein the gas supply part includes:

a gas compression part configured to compress the gas, and a supply line configured to transfer the gas compressed by the gas compression part to the metal pipe material, wherein the supply-side pressure detector is provided in the supply line, wherein the gas discharge part includes:

a discharge line configured to transfer the discharged gas from the metal pipe material, and wherein a discharge-side pressure detector is provided in the discharge line, the discharge-side pressure detector is configured to detect a pressure of the gas in the discharge line.

* * * * *